United States Patent [19]

Goloff

[11] 3,931,977

[45] Jan. 13, 1976

[54] SEAL ASSEMBLY FOR ROTARY MECHANISMS

[75] Inventor: Alexander Goloff, East Peoria, Ill.

[73] Assignee: Caterpillar Tractor Co., Peoria, Ill.

[22] Filed: May 1, 1975

[21] Appl. No.: 573,681

[52] U.S. Cl. ..... 277/81 P; 277/11; 418/113

[51] Int. Cl.[2] ..... F01C 19/02; F16J 15/24

[58] Field of Search ..... 277/9.5, 11, 81, 81 P; 418/113, 140, 248

[56] References Cited

UNITED STATES PATENTS

| | | | |
|---|---|---|---|
| 3,081,745 | 3/1963 | Hurley | 277/81 P |
| 3,685,922 | 8/1972 | Lamm | 418/113 |
| 3,721,510 | 3/1973 | Gilbert | 418/113 |
| 3,768,936 | 10/1973 | McCormick | 418/113 |
| 3,830,600 | 8/1974 | Shimoji | 418/113 |
| 3,885,799 | 5/1975 | Bibbens | 277/81 P |

*Primary Examiner*—Robert I. Smith
*Attorney, Agent, or Firm*—Ralph E. Walters

[57] ABSTRACT

An improved rotary mechanism such as a rotary engine provided with improved seals. The mechanism includes an operating chamber with a rotor therein, the rotor being provided with at least one seal receiving groove. An improved seal is located in the groove and comprises a seal element extending partially out of the groove, a spring secured to the seal for biasing the seal into sealing engagement with the chamber walls, and a carrier element secured to the spring. The carrier element includes resilient means having an unstressed width slightly greater than the width of the groove to grip the groove to positively retain the unitized seal assembly therein.

8 Claims, 4 Drawing Figures

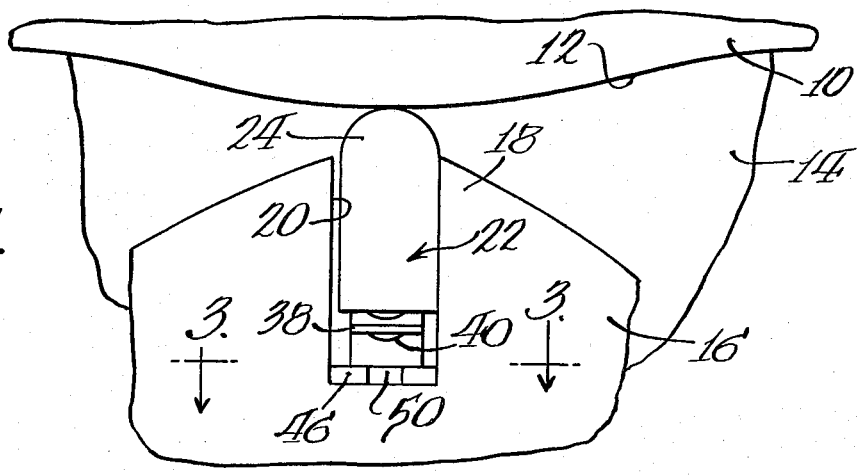
Fig. 1.
Fig. 2.
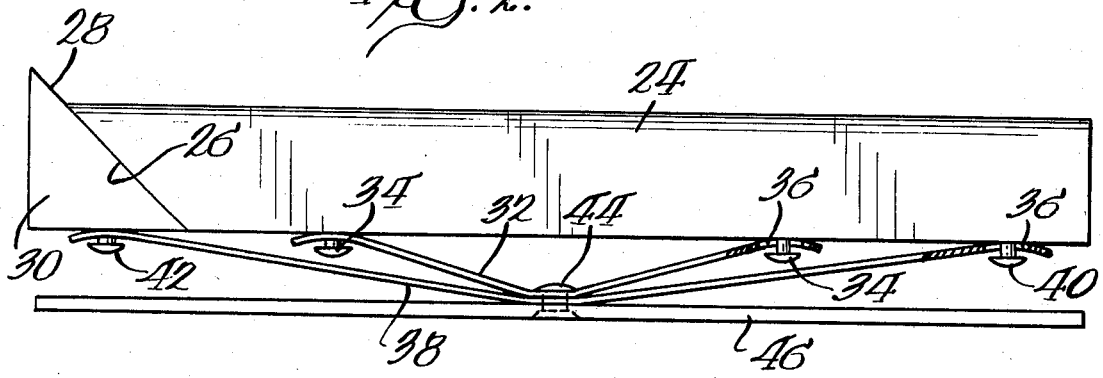
Fig. 3.
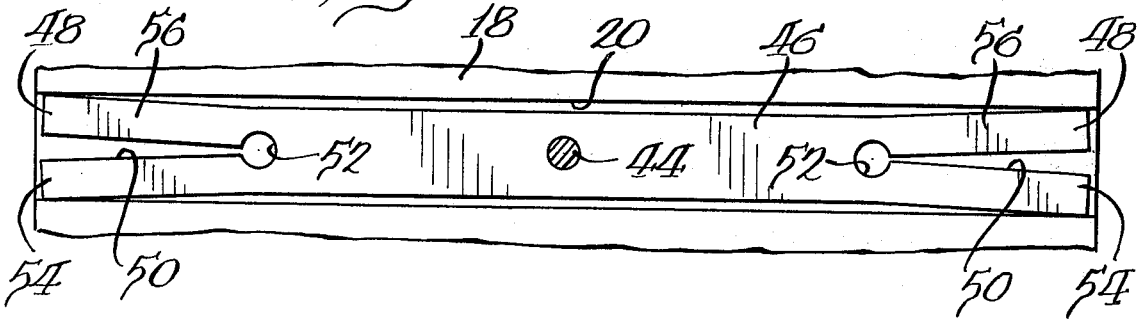
Fig. 4.
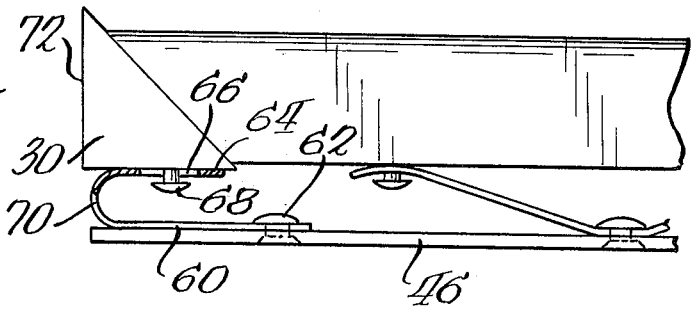

SEAL ASSEMBLY FOR ROTARY MECHANISMS

BACKGROUND OF THE INVENTION

This invention relates to rotary engines and, more particularly, to seal assemblies for rotary engines.

Prior art of possible relevance includes the following U.S. patents: U.S. Pat. No. 3,046,069 to Schmidt, issued July 24, 1962; U.S. Pat. No. 3,127,095 to Froede, issued Mar. 31, 1964; U.S. Pat. No. 3,152,552 to Frenzel, issued Oct. 13, 1964; U.S. Pat. No. 3,176,609 to Maurhoff, issued Apr. 6, 1965; U.S. Pat. No. 3,193,188 to Bentele, issued July 6, 1965; U.S. Pat. No. 3,281,064 to Springer, issued Oct. 25, 1966; U.S. Pat. No. 3,400,691 to Jones, issued Sept. 10, 1968; U.S. Pat. No. 3,556,695 to Yamamoto, issued July 19, 1971; U.S. Pat. No. 3,667,877 to Lamm, issued June 6, 1972; U.S. Pat. No. 3,712,767 to Beutter, issued Jan. 23, 1973; U.S. Pat. No. 3,745,630 to Bensinger, issued July 17, 1973.

While the operating principles of various types of rotary engines have long been known, to date they have not met with appreciable commercial acceptance. One significant drawback to the commercialization of such engines resides in the problems posed by the seals carried by the rotors employed.

Problems with seals can be divided into many areas and the instant invention is concerned with the overcoming of two problems typically encountered with seals.

A first problem is that of obtaining good sealing contact between the ends of an apex seal in a rotary engine. Typically, the total length of an apex seal is made somewhat less than the width of the rotor to allow for expansion of the seal due to high operating pressures and to preclude the ends of such seals from causing unnecessary wear on the sides of the engine operating chamber. In typical constructions, a gap will always exist with the consequence that some leakage will occur at the ends of an apex seal with the ultimate consequence of reduced operating efficiency.

Another problem encountered with apex seals is that frequently the same require a multiplicity of parts. Frequently, each seal will be comprised of a main sealing bar provided with a wedge at one, or both ends. In addition, one or more springs are employed to bias the sealing bar and the wedge into sealing engagement with the walls of the operating chamber. Not infrequently, a minimum of four parts are employed. Given a typical rotary engine of the so-called "Wankel" variety, there will be at least twelve parts required for apex seals.

Installation of the seals in such an engine becomes a nightmare since, typically, the springs will be pushing the remaining parts out of the seal receiving grooves. Frequently, the prior art has resorted to the use of taping such parts in place to overcome the aforementioned problem. However, frequently, a mechanic or an assembler on an assembly line will forget to remove such tape with the result of operational difficulties. In addition, because of the multiplicity of parts, frequently, one or more parts may be omitted through inadvertence, again causing operational difficulties.

SUMMARY OF THE INVENTION

It is a principal object of the invention to provide a new and improved rotary engine. More specifically, it is an object of the invention to provide such an engine with an improved seal assembly.

An exemplary embodiment of the invention achieves the foregoing object in a construction employing a rotary mechanism having an operating chamber and a rotor within the chamber. At least one seal receiving groove is disposed in the rotor and a sealing means is disposed in the groove. The improved sealing means of the invention comprises a unitized seal assembly disposed within the groove and includes a seal extending partially out of the groove to sealingly engage the wall of the operating chamber. A spring is secured to the seal for biasing the seal into the aforementioned sealing engagement and a carrier element is disposed in the groove and secured to the spring. The carrier element includes resilient means having an unstressed width slightly greater than the width of the groove so that when the carrier element is disposed within the groove, the resilient means will grip the groove. Because all parts are secured together, a unitized assembly results which, when once placed within the groove, will be retained therein to assist in the assembly of such devices. The unitized construction also precludes the inadvertent omission of parts.

According to a preferred embodiment, the spring is secured to the seal by a lost motion connection to provide suitable flexing and allowing gas energization of the seal for good sealing purposes.

In a highly preferred embodiment of the invention, the seal is defined by an elongated sealing bar formed of a relatively hard material and is provided with at least one wedge at one end thereof, the wedge being formed of a relatively soft material.

The invention contemplates, in a highly preferred embodiment, that the resilient means be defined by cleft ends in the carrier element.

According to a modified embodiment of the invention where a wedge is employed, at least two spring elements are employed, one for biasing the main sealing bar and one for biasing the wedge. According to this embodiment, the spring biasing the wedge is a U-shaped spring having one leg secured to the wedge and another secured to the carrier element. The bight of the U-shaped spring is located to be very nearly aligned with an end of the wedge to be adjacent a wall of the operating chamber to minimize working fluid leakage therearound. This construction may be advantageously employed to allow the ommision of so-called "bolt" seals in connection with apex seals.

Other objects and advantages will become apparent from the following specification taken in connection with the accompanying drawings.

DESCRIPTION OF THE DRAWINGS

FIG. 1 is a fragmentary, side elevation of a rotary mechanism made according to the invention;

FIG. 2 is an elevational view of a unitized seal assembly employed in the mechanism of FIG. 1;

FIG. 3 is a sectional view taken approximately along the line 3—3 in FIG. 1; and FIG. 4 is a fragmentary elevational view of a modified embodiment of a sealing assembly made according to the invention.

DESCRIPTION OF THE PREFERRED EMBODIMENTS

An exemplary embodiment of a rotary mechanism made according to the invention is illustrated in FIG. 1 and is seen to include a center housing 10 having an interior opening 12 defining a wall of an operating chamber which, if the rotary mechanism is a so-called Wankel engine, will be in the form of an epitrochoid.

The center housing 10 is flanked by a pair of end housings 14, only one of which is shown, which complete the means defining the operating chamber. Within the chamber thus defined, there is disposed, in a conventional fashion, a rotor 16 having a plurality of apices 18, only one of which is shown. At each apex 18, there is provided a seal retaining groove 20 and a seal assembly, generally designated 22, is located therein.

As seen in FIGS. 1–3, the seal assembly 22 includes an elongated sealing bar 24 which is formed of a relatively hard material. Suitable materials for the purpose are well known in the art and form no part of the instant invention. At least one end 26 of the sealing bar 24 is diagonally formed to mate with a diagonal surface 28 on a wedge 30. According to the invention, the wedge 30 is formed of a relatively soft material. Again, suitable materials for the purpose are known in the art and form no part of the instant invention.

From the foregoing, it will be appreciated that the sealing bar 24 together with the wedge 30 define a seal in accordance with the invention.

The seal assembly 22 also includes spring means for biasing the seal out of the groove 20 into sealing engagement with the walls of the operating chamber. Specifically, a first spring 32 is secured as by rivets 34 to the underside of the sealing bar 24. Adjacent each rivet 34, the spring 32 is slotted as at 36 to provide a lost motion connection so as to enable the sealing bar 24 to shift axially and laterally relative to the spring 32. This construction permits gas energization of the seal as will be seen.

A second spring element 38 is connected by a rivet 40 to the underside of the sealing bar 24 and by a rivet 42 to the underside of the wedge 30. Again, slots 36 to provide a lost motion connection are located in the spring 38 adjacent the rivets 40 and 42.

The spring 32 serves to bias the sealing bar 24 into good sealing engagement with the opening 12 in the center housing 10, while the spring 38 serves the same function. In addition, the spring 38 provides a similar bias to the wedge 30 which not only biases the same toward the wall defined by the opening 12, but toward the wall defined by the adjacent end housing 14.

It will be recognized that wedges such as the wedge 30 can be employed at either or both ends of the sealing bar 24. It will also be appreciated by those skilled in the art that the mating surfaces 26 and 28 of the sealing bar 24 and wedge 30, respectively need not be linear as shown but may be arcuate if desired.

A seal assembly made according to the invention is completed by the provision of a rivet 44 extending through both of the springs 32 and 38 adjacent their midpoints to join the same to a carrier element 46. The carrier element 46 may be a thin plate and, as best seen in FIG. 3, includes cleft ends 48. The cleft ends 48 are defined by elongated slots 50 terminating inwardly of the ends of the carrier element 46 in circular openings 52 for stress relief. As a consequence, each end includes a leg 54 and an adjacent leg 56 and the same are flared outwardly to a width slightly greater than the width of the groove 20, when in an unstressed condition. As a consequence, when a seal assembly 22 made according to the invention is introduced into a groove 20, the inherent resilience of the cleft ends 48 will cause the same to wedge against the sides of the groove 20 to retain the entire seal assembly in place.

As a result of the foregoing, it will be appreciated that a seal assembly made according to the invention is a unitized construction whereby parts cannot be inadvertently omitted by an assembler or mechanic. It will also be appreciated that the difficulty in assembly experienced with prior art constructions is eliminated since only the unitized assembly need be inserted in a groove 20 and once placed therein, will be retained until some positive effort is made to remove the same.

It will also be appreciated that sealing difficulties adjacent the ends of an apex seal are eliminated by the foregoing construction employing a hard sealing bar 24 and a soft wedge 30. Because of the proximity of the ends of a sealing bar to the end housings, the ends of such a sealing bar are at cooler temperatures than the center portion thereof during normal engine operation. Consequently, oil films are more readily maintained and wear is not as great a problem. Because the wedge 30 is formed of a relatively soft material and wear is not a particular problem, is is virtually impossible to develop a situation where the sharp point of the wedge rides on the housing to gouge the same, as is the case with prior art constructions. Being softer than either the sealing bar 24 or a typical housing, it will break in without wearing the housing.

In general, when the engine is cold, the overall length of the apex seal will be at its least dimension and the wedge will engage the side housing. As the seal heats up due to thermal expansion, the wedge 30 will retract somewhat against the bias of the spring 38 will retract to leave a slight gap. However, the typical fretting in the engine caused by deflections and machining errors will cause motion of the seal and the wedge to cause the latter to wear slightly. As a consequence, the aforementioned slight gap will "heal" due to tolerable wear of the wedge 30.

A modified embodiment of the invention is illustrated in FIG. 4. In this embodiment, the spring 38 is replaced by a U-shaped spring 60 secured to a carrier 46 provided with cleft ends (not shown) by a rivet 62. That is, one leg of the U-shaped spring 60 is secured to the carrier 46. Another leg 64 is secured through a lost motion connection 66 by a rivet 68 to the wedge 30. The arrangement is such that the bight 70 of the U-shaped spring 60 is very nearly aligned with the end 72 of the wedge 30 so as to be in close adjacency to a wall of the operating chamber. If the width of the spring 60 is made only about 0.001 inches less than the width of the groove 20, and the bight 70 is spaced from a projection of the linear surface defined by the side 72 of the wedge 30 a similar distance, and there is no more than 0.100 inches spacing between approximately the center of the bight 70 and the beginning of each of the legs of the spring 60, only a leakage area of 0.0002 square inches will be present. On the other hand, in a typical construction employing a so-called bolt at each end of an apex seal, the leakage area will typically be on the order of 0.0005 square inches or approximately 2½ times greater. Thus, it will be appreciated that the embodiment illustrated in FIG. 4 can be advantageously employed to avoid the need of so-called bolts thereby reducing the number of parts and increasing sealing efficiency.

From the foregoing, it will be apparent that a seal assembly made according to the invention achieves the previously stated object of eliminating difficulties in engine assembly as well as providing increased seal efficiency. While the invention has been described in connection with a rotary engine of the so-called Wankel type, skilled in the art will readily recognize that the invention may be advantageously employed in rotary engines of other configurations as well as rotary mechanisms such as pumps, compressors, or the like.

What is claimed is:

1. In a rotary mechanism having means defining an operating chamber, a rotor within said chamber, at least one seal receiving groove in said rotor, and sealing means in said groove; the improvement wherein said sealing means comprises a unitized seal assembly disposed within said groove and including a seal extending partially out of said groove to sealingly engage a wall of said operating chamber, spring means secured to said seal for biasing said seal into said sealing engagement, and a carrier element in said groove and secured to said spring means, said carrier element including resilient means having an unstressed width slightly greater than the width of said groove, whereby when said carrier element is disposed within said groove, said resilient means will grip said groove to positively retain said unitized seal assembly within said groove.

2. The rotary mechanism of claim 1 wherein said spring means is secured to said seal by a lost motion connection.

3. A rotary mechanism according to claim 1 wherein said resilient means is defined by a cleft portion of said carrier element.

4. A rotary mechanism according to claim 1 wherein said resilient means is defined by cleft ends of said carrier element.

5. The rotary mechanism of claim 1 wherein said seal is defined by an elongated sealing bar formed of a relatively hard material and a wedge element at at least one end of said bar and formed of a relatively soft material, said spring means being secured to said wedge element and to said sealing bar so as to allow relative movement therebetween.

6. The rotary mechanism of claim 5 wherein said spring means comprise a first spring element secured to said edge and a second spring element secured to said sealing bar, both said spring elements being secured to said carrier element.

7. The rotary mechanism of claim 6 wherein said first spring element is further secured to said sealing bar at the end thereof opposite from said wedge.

8. The rotary mechanism of claim 6 wherein said first spring element comprises a generally U-shaped spring having one leg secured to said wedge and another leg secured to said carrier element, the bight of said U-shaped spring being very nearly aligned with an end of said wedge remote from said sealing bar and having a width just slightly less than the width of said groove to minimize working fluid leakage around said first spring element.

* * * * *

UNITED STATES PATENT OFFICE
CERTIFICATE OF CORRECTION

PATENT NO. : 3,931,977

DATED : January 13, 1976

INVENTOR(S) : Alexander Goloff

It is certified that error appears in the above-identified patent and that said Letters Patent are hereby corrected as shown below:

Column 4, line 20, change "is" (first occurrence) to --it--;

Column 5, line 2, after "type," insert --those--;

Column 6, line 13, change "edge" to --wedge--.

Signed and Sealed this

*eighth* Day of *June 1976*

[SEAL]

*Attest:*

RUTH C. MASON
*Attesting Officer*

C. MARSHALL DANN
*Commissioner of Patents and Trademarks*